US005195590A

United States Patent [19]

Kenner

[11] Patent Number: 5,195,590

[45] Date of Patent: * Mar. 23, 1993

[54] METHOD AND APPARATUS FOR PROTECTING AN ENVIRONMENTAL MONITORING WELL HEAD

[76] Inventor: Donald A. Kenner, Rt. 3, Box 220A, Sherwood, Oreg. 97006

[ * ] Notice: The portion of the term of this patent subsequent to Apr. 30, 2008 has been disclaimed.

[21] Appl. No.: 753,639

[22] Filed: Aug. 30, 1991

Related U.S. Application Data

[60] Division of Ser. No. 565,139, Aug. 10, 1990, Pat. No. 5,063,996, which is a continuation-in-part of Ser. No. 397,010, Aug. 22, 1989, Pat. No. 5,010,957.

[51] Int. Cl.[5] ..... E21B 33/03

[52] U.S. Cl. ..... 166/379; 52/20; 137/371; 166/75.1; 166/85; 404/25

[58] Field of Search ..... 166/378, 379, 75.1, 166/81, 96, 85, 92-95, 97; 52/20; 220/18, 484; 141/86; 404/25, 26; 137/363, 364, 371

[56] References Cited

U.S. PATENT DOCUMENTS

| | | | |
|---|---|---|---|
| 653,909 | 7/1900 | Greger | 404/25 |
| 759,091 | 5/1904 | Delehanty . | |
| 1,509,643 | 9/1924 | Forsberg | 138/90 |
| 1,766,621 | 6/1930 | Fleming | 404/25 X |
| 1,933,469 | 10/1933 | Aylward | 220/484 X |
| 3,063,500 | 11/1962 | Logan | 166/96 X |
| 3,220,433 | 10/1965 | Steil | 137/363 |
| 3,463,196 | 8/1969 | Richardson | 138/96 |
| 3,473,573 | 10/1969 | Baker et al. | 138/89 |
| 3,823,744 | 7/1974 | Logsdon | 138/96 |
| 3,856,050 | 12/1974 | Rooney | 138/96 |
| 3,942,681 | 3/1976 | Richardson | 220/324 |
| 4,014,367 | 3/1977 | Milo | 138/89 |
| 4,202,378 | 5/1980 | Bush et al. | 138/96 |
| 4,212,486 | 7/1980 | Logsdon | 285/4 |
| 4,335,740 | 6/1982 | Boley | 137/364 |
| 4,527,708 | 7/1985 | Dundas et al. | 141/86 X |
| 4,655,361 | 4/1987 | Clover et al. | 141/86 X |
| 4,669,536 | 6/1987 | Ames et al. | 166/68 |
| 4,696,330 | 9/1987 | Randman et al. | 141/86 |
| 4,706,718 | 11/1987 | Milo | 137/371 X |
| 4,723,866 | 2/1988 | McCauley | 404/25 |
| 4,747,453 | 5/1988 | Howard, Sr. | 166/96 X |
| 4,881,597 | 11/1989 | Hensley | 166/92 |
| 4,971,149 | 11/1990 | Roberts | 166/92 |
| 5,010,957 | 4/1991 | Kenner | 166/379 |

FOREIGN PATENT DOCUMENTS

| | | | |
|---|---|---|---|
| 1515278 | 6/1978 | United Kingdom | 52/20 |

*Primary Examiner*—Hoang C. Dang
*Attorney, Agent, or Firm*—William A. Birdwell & Associates

[57] ABSTRACT

An environmental monitoring well housing and protection method. A housing is disposed over the end of an environmental monitoring well pipe and set in concrete along with the well pipe itself so that the space between the housing and the well pipe is filled with concrete below the end of the well pipe. Fins extend outwardly from the housing into the concrete to anchor the housing. The housing has an interior ledge for receiving and supporting a cover. A flexible gasket is placed on the ledge, the cover is placed on the flexible gasket, and the two are fastened down by a pair of bolts that screw into threaded bores in the ledge. The bolts have five-sided heads and a special tool is provided for installing and removing them. The cover thickness is substantially the same as the distance from the top of the housing down to the ledge, so that where the top of the housing is mounted flush with the ground the top of the cover is also flush with the ground. The cover includes recesses for the heads of each of the bolts, so that the resultant well head is entirely flush with the surface of the ground. The flexible gasket has an adhesive material on its underside for attachment to the ledge. Apertures in the cover through which the bolts extend are sized to receive a tip of the special tool for use in lifting the cover.

13 Claims, 2 Drawing Sheets

METHOD AND APPARATUS FOR PROTECTING AN ENVIRONMENTAL MONITORING WELL HEAD

This is a division of application Ser. No. 565,139 filed Aug. 10, 1990, now U.S. Pat. No. 5,063,996, which application in turn is a continuation-in-part of patent application Ser. No. 397,010 filed Aug. 22, 1989, now U.S. Pat. No. 5,010,957.

BACKGROUND OF THE INVENTION

This invention relates to devices and methods for housing and protecting well heads, particularly for housing and protecting the heads of environmental monitoring wells while permitting convenient access thereto.

It has become a common practice to install monitoring wells in the ground in areas where the ground water is at risk of contamination. Such wells, known as environmental monitoring wells, are typically installed, for example, around the periphery of solid waste landfills or where there has been, or there is a potential for, a hazardous or toxic chemical spill. Water is periodically extracted from the wells and tested for the presence of contaminants.

Basically, environmental monitoring wells are just pipes installed vertically in the ground, extending to various depths and terminating at a well head near the surface of the ground. Typically, there is no substantial permanent equipment located at the well head; it is simply capped between usages. In some cases there may be a small monitoring device installed at the well head. There is ordinarily no attendant at the well head; it is only visited periodically to extract water for tests or, in some cases, to check a small monitoring device.

There is a risk that an environmental monitoring well can itself become a source of contaminants. This will happen if surface water containing contaminants, or an undiluted contaminant itself, is allowed to enter the well pipe. This can occur, for example, if there is uncontainedsurface water adjacent the well head at the time that it is uncapped for testing, or where the cap is not adequately sealed. It can also occur where part of the well head protrudes above the surface of the ground and is damaged by the movement of vehicles or heavy equipment, leaving the interior of the well pipe exposed in a manner that permits the introduction of contaminants. It is important to ensure that this does not occur.

In order to minimize the likelihood that environmental monitoring wells will contaminate the very water they are installed to test, it is desirable, if not required, to provide them with a fluid resistant housing in addition to the well cap itself; indeed it is desirable to provide a housing that is impervious to water and other fluids, i.e., fluid-tight. Known housings typically extend above the surface of the ground and provide a cover that is less than fluid-tight. For example, Ames et al. U.S. Pat. No. 4,669,536 discloses a protective housing disposed around the end of a monitoring well pipe, set in concrete and having a hinged cover on top. But, the housing extends above the surface of the ground where it can interfere with, and be damaged by, the movement of vehicles and equipment. There is no provision for making the hinged cap fluid-tight.

In addition, various types of caps are available for sealing pipes in general. Delahanty U.S. Pat. No. 759,081 shows a cap which, together with a gasket, is fastened to the end of a pipe by bolts. Baker et al. U.S. Pat. No. 3,473,573 and Forsburg U.S. Pat. No. 1,509,643 disclose well caps which are also fastened with bolts and include gaskets. Rooney U.S. Pat. No. 3,856,050 and Richardson U.S. Pat. No. 3,942,681 show flange protectors for placement over the ends of flanged pipes. However, none of these devices is, or could readily be, adapted to provide a fluid-tight cover for an environmental monitoring well that is in addition to the well pipe cap itself and is flush with the ground.

It has also been found that frost can dislodge a well housing, thereby breaking the seal and opening the well bore to contamination. When the environmental monitoring well is located in a location accessed or accessible by the public, there is a need for a well head housing that is resistant to tampering or vandalism by unauthorized personnel. Such actions can also destroy the integrity of the housing and allow contaminants to enter the well bore.

Therefore, it can be seen that there is a need for a new and improved environmental well housing that minimizes the risk of contamination of the ground water which the well is installed to monitor.

SUMMARY OF THE INVENTION

The present invention meets the aforementioned need for an effective environmental well housing, and overcomes the drawbacks of currently available devices, by providing, in a preferred embodiment, a housing that is in addition to the well pipe cap itself, is flush to the ground, and is fluid-tight. An enclosure is disposed over the end of the well pipe and set in concrete along with the well pipe itself, so that the space between the enclosure and the well pipe is filled with concrete below the end of the well pipe, thereby sealing out contaminant fluids from below. The housing has an interior ledge for receiving and supporting a cover. A flexible gasket is placed on the ledge, the cover is placed on the flexible gasket, and the two are fastened down by a pair of bolts that screw into threaded bores in the ledge, thereby providing a fluid-tight seal for the top of the well. The cover thickness is substantially the same as the distance from the top of the enclosure down to the ledge, so that where the top of the enclosure is mounted flush with the ground the top of the cover is also flush with the ground. This arrangement produces a fluid-tight chamber for access to the upper end of the well pipe.

The cover includes recesses for the heads of each of the bolts, so that the resultant well head assembly is entirely flush with the ground surface. The rubber gasket has an adhesive material on its underside for attachment to the ledge, thereby ensuring that it will stay in place as the cover is attached and removed from time to time.

The cover has apertures for receiving the bolt shaft that is threaded into the threaded bores of the ledge. The apertures are larger than the outer diameters of the bolts for receiving a rod end of an opening tool. The rod end is too large to fit into the ledge bores, thereby facilitating lifting of the cover from the enclosure without damaging the bore threads. Further the bolt preferably has a nonstandard head, such as with five sides, in order to deter unwanted tampering. The enclosure outer surface also has fins that project outwardly for anchoring it into the concrete.

Therefore, it is a principal objective of the present invention to provide a novel and improved environmental monitoring well housing and protection method.

It is another objective of the present invention to provide an environmental monitoring well housing that is in addition to the well pipe cap itself.

It is a further objective of the present invention to provide an environmental monitoring well housing that is tamper-proof.

It is also an objective of the present invention to provide a tool for facilitating opening a cover of the tamper-proof housing.

It is yet another objective of the present invention to provide an environmental well housing that is anchored into the well head.

It is a feature of the present invention that it provides a cover having apertures that a fastener, such as a bolt, passes through having a diameter accommodating a tool for lifting the cover.

It is another feature of the present invention that it includes the fastener or bolt with a nonstandard head.

It is a further feature of the present invention that it employs an enclosure on which the aforesaid cover seats, and has an anchor that secures the enclosure in the well bore.

It is yet a further feature of the present invention that it provides a tool that engages the nonstandard bolt head and has a rod end that is received in a cover aperture for lifting the cover.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
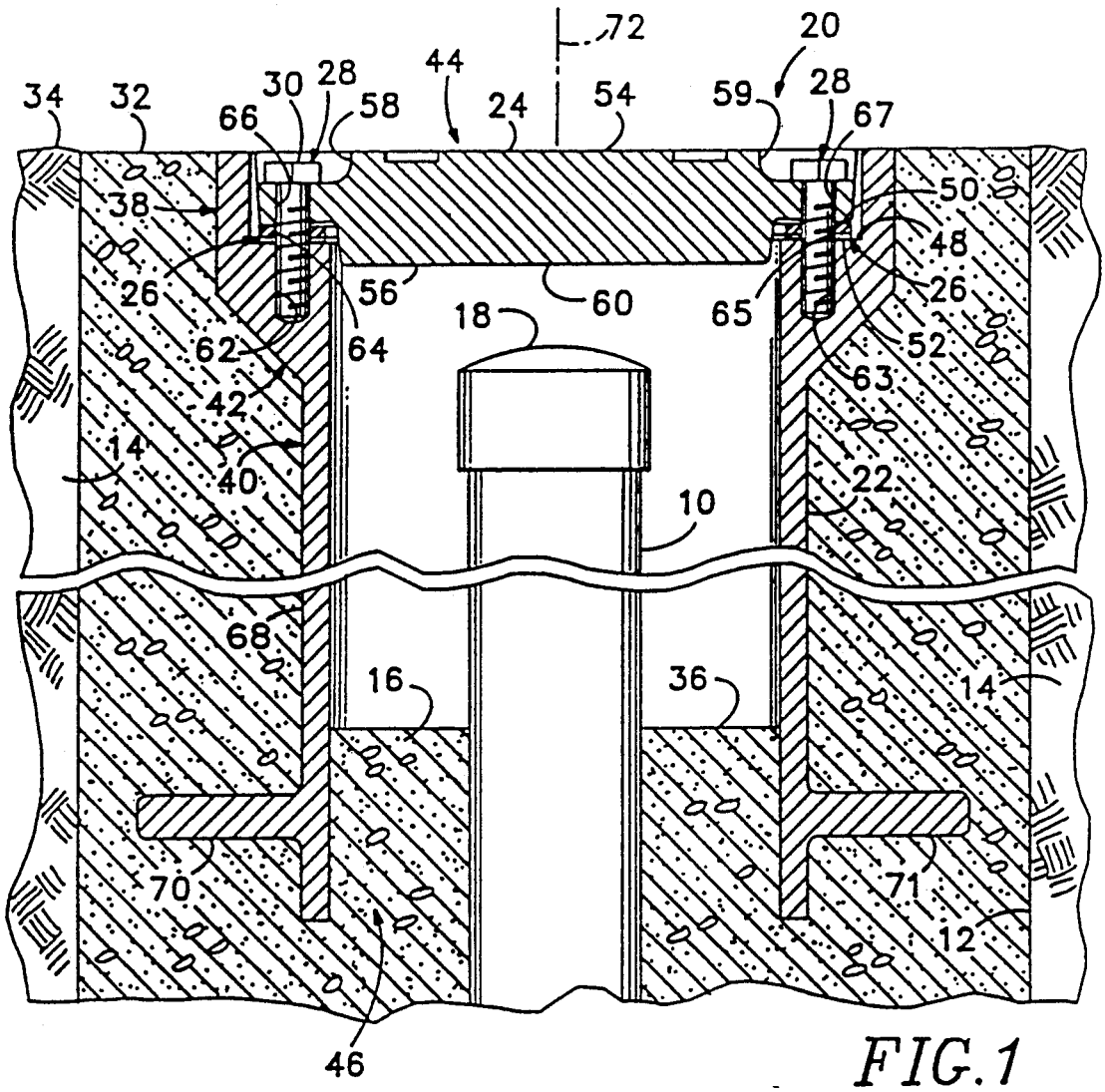
FIG. 1 is a cross section of a preferred embodiment of the environmental monitoring well housing of the present invention, installed in the ground together with an environmental monitoring well.

An overview of a preferred embodiment of the environmental monitoring well housing of the present invention installed in the ground at the head of a well is shown in FIG. 1. The well comprises a cylindrical pipe 10 disposed vertically, and extending down, in the ground for accessing ground water at a selected level. The well pipe is disposed at the center of a bore 12 in the ground 14, and surrounded by concrete 16 to a predetermined depth. Various other packing materials are typically disposed below the concrete. The top of the pipe is ordinarily closed by a cap 18, which is typically just a cup-shaped device that is pressure fit onto the pipe 10, though it may be attached by a variety of other means.

The environmental well housing 20 comprises an enclosure 22 disposed around the well pipe 10 at the top thereof and set in the concrete 16 along with the well pipe so that the concrete fills the space between the inside of the enclosure and the outside of the well pipe. A cover 24 fits within the enclosure 22 at the top thereof so as to provide a substantially flat top surface. A flexible gasket 26 is disposed between the cover 24 and the enclosure to provide a fluid-tight assembly. The cover and gasket are attached firmly to the enclosure by a pair of bolts, such as bolt 28. Bolts 28 have standard threaded shanks, but have nonstandard heads 30. Although any nonstandard configuration could be used, the preferred form is a five-sided head instead of a standard four or six-sided head. This makes it difficult to open with a conventional socket or other wrench.

The enclosure is mounted in the ground with a portion 32 of the concrete 16 surrounding the outside of the enclosure so that the upper surface of the entire assembly is substantially flush with the ground level 34 when the cover 24 is installed. Inside the enclosure the concrete 16 rises a few inches above the bottom of the enclosure to a level 36 several inches below the top of the well pipe 10.

Figure 2:
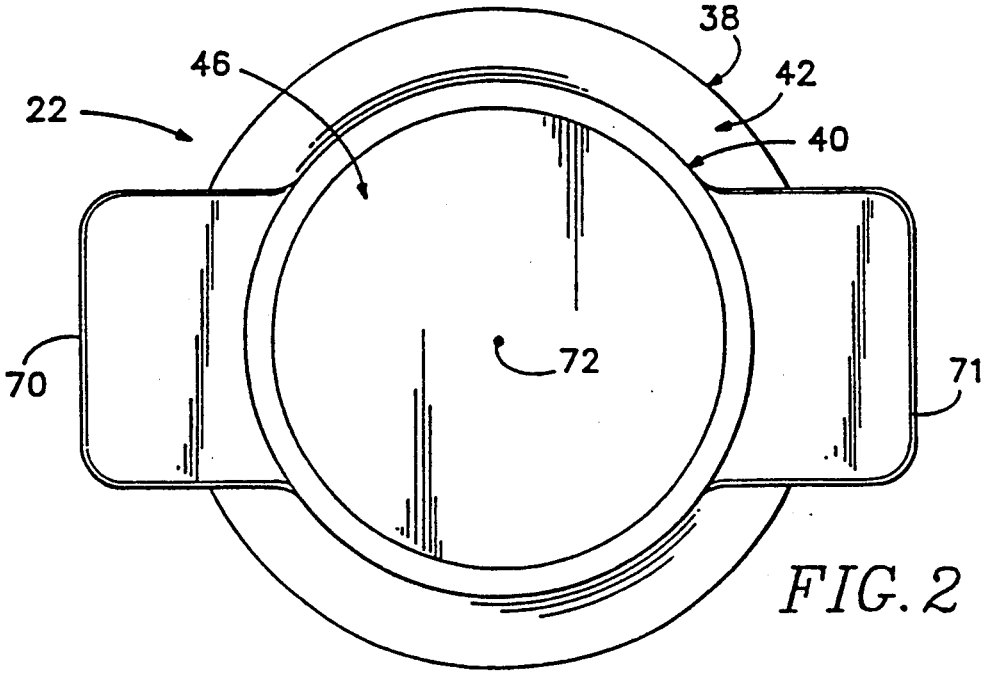
FIG. 2 is an end view of the enclosure of the housing of FIG. 1 as viewed from the bottom of that figure.

The enclosure 22 of the well housing preferably, though not necessarily, comprises cylindrical sections, as shown by the bottom view of FIG. 2. It has an upper section or end 38 of a first diameter, a lower section or end 40 of a second, smaller diameter, and a central section 42 that tapers from the upper section 38 to the lower section 40. The upper section provides an upper opening 44, and the lower section provides a lower opening 46. An inwardly-protruded ledge 48 is inside the enclosure, disposed above the central section 42, for supporting the flexible gasket 26 and teh cover 24. Preferably, the enclosure 22 and cover 24 are made of cast and machined aluminum.

The outer peripheral of the gasket 26 and the cover 24 are shaped to fit just within the inner wall of the upper section 38 of the enclosure 22. Thus, in the case of an enclosure having cylindrical sections, the cover 24 is disc shaped and the gasket 26, like the upper surface of the ledge 48, is ring shaped.

The gasket 26 has a top portion 50 made of a flexible material, such as rubber, to seal the joint between the cover 24 and ledge 48 when compressed. It also has a bottom portion 52 comprising an adhesive backing for attaching the gasket 26 to the ledge 48 so as to retain the gasket in place when the cover is installed and removed from the enclosure from time to time.

The cover has an upper surface 54 and a lower surface 56, and a pair of recesses 58 and 59 in the upper surface for receiving the heeads of bolts 28. The lower surface 56 may, but need not necessarily, include an offset 60. Thence, when the cover is installed the bolt heads are disposed below the upper surface of the cover so that the entire assembly is substantially flush with the surface of the ground. The ledge has a pair of threaded bores 62 and 63 for receiving the bolts 28 so that the cover may be firmly fastened to the enclosure. The gasket 26 has a pair of apertures 64 and 65 for allowing the bolts to pass therethrough. The cover 24 also has a pair of apertures 66 and 67 having a diameter slightly larger than the diameter of bores 62 and 63. More than two bolts may be used, if desired, to ensure that the fluid-tight seal is not broken. In any event, the bolts should be disposed symmetrically around the periphery of the housing.

As shown in FIGS. 1 and 2, enclosure 22 has a vertical outer surface 68 in the lower section 40 from which a pair of protrusions or fins 70 and 71 extend radially outwardly in opposite directions. These fins are preferably plate-like and disposed close to lower opening 46. These fins extend only partially around the enclosure so that the enclosure can be placed in concrete and the concrete will flow up along outer surface 68 between the fins. In order to assure that the fins are embedded in the concrete, the enclosure can be rotated about the longitudinal axis 72 of the enclosure and retained in this position until the concrete cures.

Fins 70 and 71 serve as anchors for securing the enclosure in the concrete, and therefore in the well head. These anchors prevent the lifting or dislodging of the enclosure, due to winter freezing conditions or possibly even vandalism.

Figure 3:
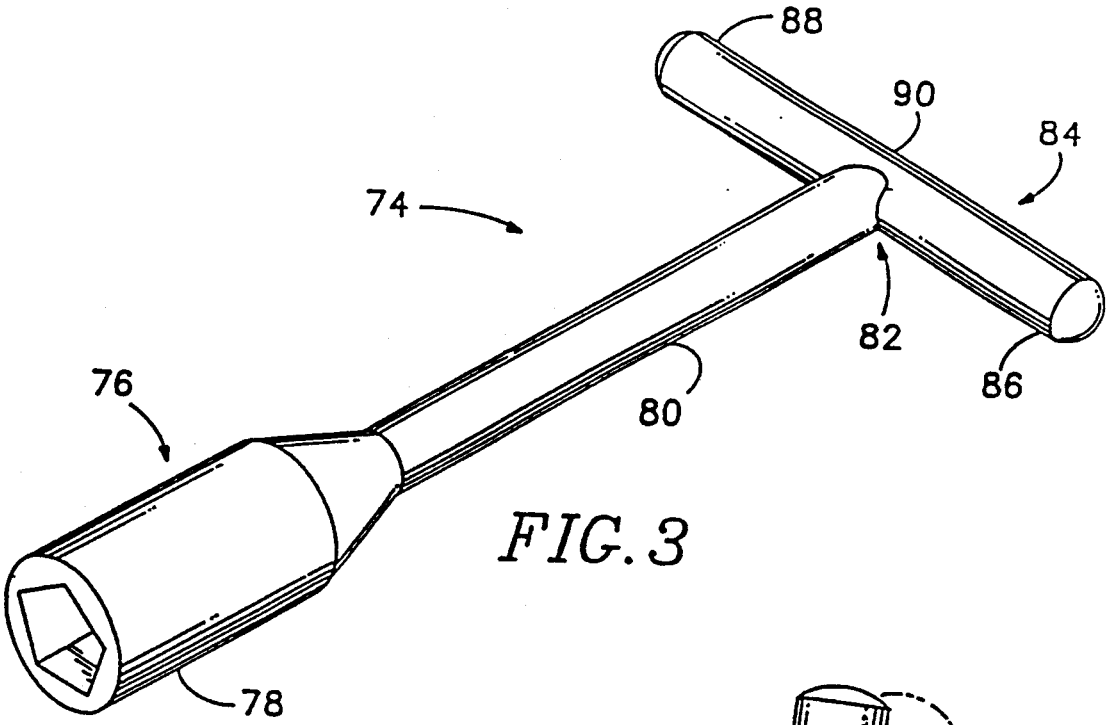
FIG. 3 is an isometric view of a tool usable for installing and removing the housing cover of FIG. 1.

Referring now to FIG. 3, a special tool 74 is provided by the invention to accommodate the installation and removal of cover 24 from enclosure 22. The tool has a general T-shape, with the bottom or foot end 76 having a socket wrench 78 sized to conform to the five-sided bolt heads 30. Recesses 58 and 59 allow insertion of the wrench 78 onto the bolt head during use.

A shank 80, also functioning as a handle, extends from end 76 to an opposite end 82. The cross of the T-shape of the tool is formed of a rod member 84 having opposite ends 86 and 88. Member 84 is used as a handle when wrench 78 is being used. The rod member is fixed to shank 80 at an intermediate portion 90. Ends 86 and 88 are sized for sliding receipt in apertures 66, but are too large to fit into enclosure bores 62. Also, the ends are preferably rounded to facilitate insertion in the apertures of the cover. The size of rod member ends 86 and 88 prevents the rod member ends from damaging the enclosure bores while providing for lifting of the cover out of opening 44.

Figure 4:
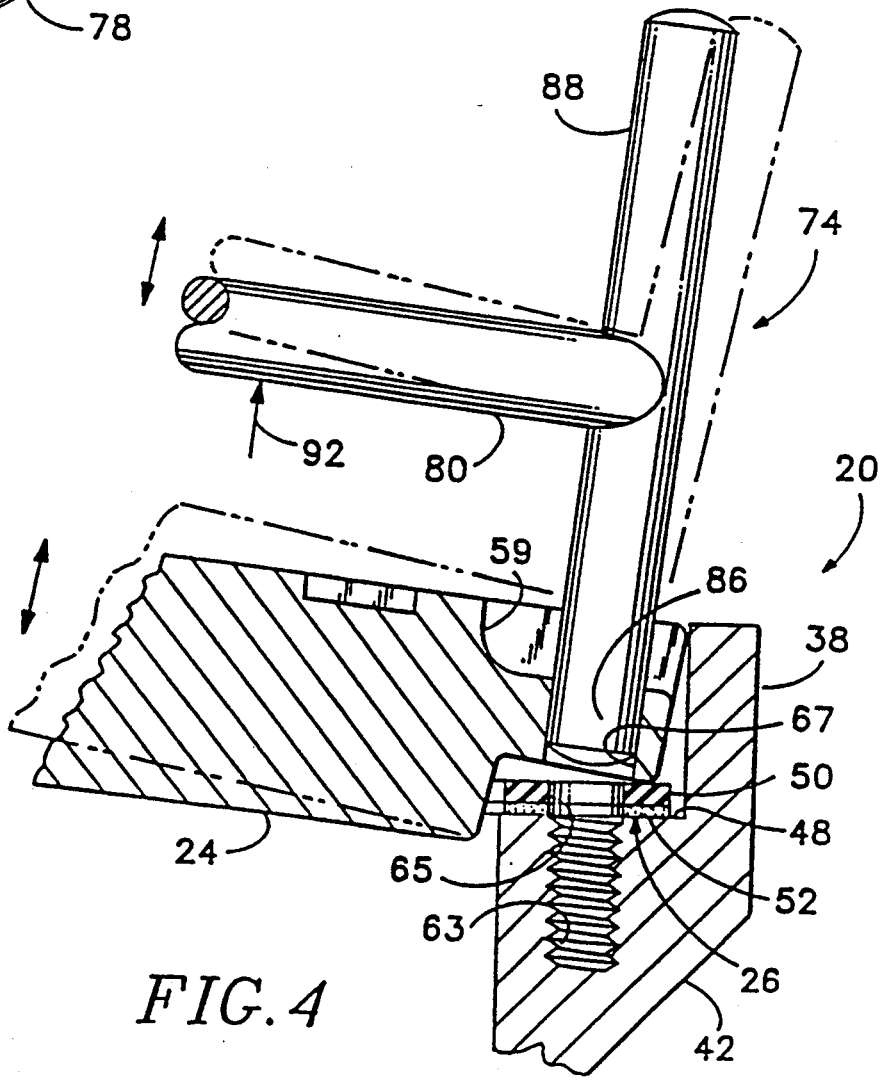
FIG. 4 is a fragmentary partial cross section showing the housing of FIG. 1 being opened with the tool of FIG. 3.

As shown in FIG. 4, this lifting capability is provided by inserting one of the rod ends into one of the cover apertures after the bolts have been removed. A lifting force is then applied to shank or handle 80, as represented by arrow 82. The leveraged or angular force applied by the rod end on the cover in the aperture produces sufficient friction to hold the rod end in the aperture while the cover is lifted.

In use, the housing is installed in the well head along with the well pipe as shown in FIG. 1. The gasket 26 is placed in the enclosure 22 on the ledge 48, the cover 24 is placed in the enclosure on top of the gasket, as has been described with reference to tool 70 and FIG. 4, and the bolts 28 are screwed into the bores 62 and 63 and tightened down. Thereafter, vehicles and machinery can be moved over the well head without obstruction or damage to the housing, which might otherwise break the fluid-tight seal. To access the well pipe for testing the ground water the bolts are removed and the cover is lifted away using tool 70.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. In an environment monitoring well having a well pipe disposed in a well bore with an upper end thereof extending toward the surface of the earth, a housing comprising:

(a) an enclosure having an upper opening and a lower end with a lower opening, said enclosure being of unitary construction and being disposed in said well bore around said upper end of said well pipe;

(b) closure means, adapted to be disposed within said enclosure at said upper opening thereof, for closing said upper opening and preventing fluid from entering therethrough, said closure means having a substantially flat upper surface substantially flush with said surface of the earth when installed in said enclosure; and (c) sealing means disposed in said well bore between the outer surface of said enclosure and the inner surface of said well bore, directly under said lower end of said enclosure and under said lower opening of said enclosure between the outer surface of said well pipe and the inner surface of said well bore, so as to seal off the space between the outer surface of said enclosure and the inner surface of said well bore and to seal off said lower opening of said enclosure, said sealing means comprising a material having a characteristic that allows it to flow into the space between the outer surface of said enclosure and the inner surface of said well bore and under said lower opening of said enclosure and to assume a stable condition.

2. The housing of claim 1, wherein said enclsoure further comprises an inwardly-protruding ledge between said upper opening and said lower opening, and said closure means comprises:

(i) a cover having an upper surface, a lower surface and a peripheral shape substantially identical to the shape of the interior of said enclosure between said ledge and said upper opening so as to fit therein; and (ii) a flexible gasket having a shape substantially identical to the shape of the surface of said ledge for placement between said cover and said ledge.

3. The housing of claim 1, wherein said upper surface of said closure means is substantially flush with said upper opening of said enclosure when installed therein.

4. A method for housing and protecting an environmental monitoring well having a well pipe disposed in a well bore with an upper end extending toward the surface of the ground, comprising:

(a) placing an enclosure in said well bore around said upper end of said well pipe, said enclosure being of unitary construction and having an upper opening and a lower end with a lower opening;

(b) placing sealing means between the outer surface of said enclosure and the inner surface of said well bore, and directly under said lower end of said enclosure and under said lower opening of said enclosure between the outer surface of said well pipe and the inner surface of said well bore, so as to seal off the space between the outer surface of said enclosure and the inner surface of said well bore and to seal off said lower opening of said enclosure, said sealing means comprising a material having a characteristic that allows it to flow into the space between the outer surface of said enclosure and the inner surface of said well bore and under said lower opening of said enclosure and to assume a stable condition;

(c) placing closure means within said enclosure at said upper end thereof to prevent fluid from entering therethrough, said closure means having a substantially flat upper surface substantially flush with said surface of the earth when installed in said enclosure; and (d) attaching said cover to said enclosure so as to seal said upper opening of said enclosure.

5. The method of claim 4 wherein said enclosure further comprises an inwardly-protruding ledge between said upper opening and said lower opening, and said closure means comprises:

(i) a cover having an upper surface, a lower surface and a peripheral shape substantially identical to the shape of the interior of said enclosure between said ledge and said upper opening so as to fit therein; and (ii) a flexible gasket having a shape substantially identical to the shape of the surface of said ledge, said method further comprising placing said gasket between said cover and said ledge.

6. The method of claim 4, wherein said upper surface of said closure means is substantially flush with said upper opening of said enclosure when installed therein.

7. In an environmental monitoring well having a well pipe disposed in a well bore with an upper end thereof extending toward the surface of the earth, a housing comprising:

(a) an enclosure having an upper end with an upper opening and a lower end with a lower opening, an outer surface extending between said upper and lower ends, said enclosure being disposed in said well bore around said upper end of said well pipe;

(b) closure means for closing said upper opening;

(c) sealing means disposed in said well bore between said outer surface of said enclosure and said inner surface of said well bore, directly under said lower end and under said lower opening of said enclosure between the outer surface of said well pipe and the inner surface of said well bore, so as to seal off the space between the outer surface of said enclosure and the inner surface of said well bore and to seal off said lower opening of said enclosure; and (d) means for anchoring said enclosure in said well bore, said mens for anchoring having a protrusion extending outwardly from said outer surface of said enclosure so as to be substantially covered by said sealing means thereby anchoring said enclosure in said well bore.

8. The housing of claim 7 wherein said protrusion is generally planar and horizontally disposed, extending partially circumferentially around said outer surface of said enclosure.

9. The housing of claim 8 wherein said means for anchoring further comprises another of said protrusions, with said protrusions being disposed on said outer surface generally opposite from each other.

10. In an environmental monitoring well having a well pipe disposed in a well bore with an upper end thereof extending toward the surface of the earth, a housing comprising:

(a) an enclosure having an upper opening and a lower end with a lower opening, said enclosure being of unitary construction and being disposed in said well bore around said upper end of said well pipe;

(b) a cover for attachment to said enclosure and closing said upper opening to prevent fluid from entering therethrough, said cover having a substantially flat upper surface which is substantially flush with said upper surface of the earth when attached to said enclosure and having recesses for receiving attachment means;

(c) a flexible gasket for placement between said cover and a portion of said enclosure around the inner periphery of said upper opening of said enclosure to prevent fluid from flowing into said enclosure through said upper opening;

(d) attachment means for attaching said cover to said enclosure, said attachment means being disposed in said recesses when said cover is attached to said enclosure thereby; and (e) sealing means disposed in said well bore under and in contact with said lower end and said lower opening of said enclosure between the outer surface of said well pipe and the inner surface of said well bore so as to seal off said lower opening of said enclosure, said sealing means comprising a material having a characteristic that allows it to flow into the space under said lower opening of said enclosure and to assume a stable condition.

11. A method for housing and protecting an environmental monitoring well having a well pipe disposed in a well bore with an upper end extending toward the surface of the earth, comprising:

(a) placing an enclosure in said well bore around said upper end of said well pipe, said enclosure being of unitary construction and having an upper opening and a lower opening;

(b) placing sealing means in said well bore under and in contact with the lower end of said enclosure between the outer surface of said well pipe and the inner surface of said well bore so as to seal off said lower opening of said enclosure, said sealing means comprising a material having a characteristic that allows it to flow into the space under said lower opening of said enclosure and to assume a stable condition;

(c) placing a flexible gasket on said enclosure around the inner peripheral of said upper opening of said enclosure to prevent fluid from flowing into said enclosure through said upper opening;

(d) placing a cover on said enclosure to close said upper opening thereof and prevent fluid from entering therethrough, said cover having a substantially flat upper surface which is substantially flush with said surface of the earth when placed on said enclosure and having recesses for receiving attachment means; and (e) attaching said cover to said enclosure with said attachment means so as to seal said upper opening of said enclosure, said attachment means being disposed in said recesses and said gasket being disposed between said cover and said enclosure.

12. In an environmental monitoring well having a well pipe disposed in a well bore with an upper end thereof extending toward the surface of the earth, a housing comprising:

(a) a monolithic enclosure having an upper opening and a lower end and with a lower opening, said enclosure being disposed in said well bore around said upper end of said well pipe;

(b) closure means, adapted to be disposed within said enclosure at said upper opening thereof, for closing said upper opening and preventing fluid from entering therethrough, said closure means having a substantially flat upper surface which is substantially flush with said surface of the earth when installed in said enclosure; and (c) sealing means disposed in said well bore under said lower opening and in contact with said lowe end of said enclosure between the outer surface of said well pipe and the inner surface of said well bore so as to seal off said lower opening of said enclosure, said sealing means comprising a material having a characteristic that allows it to flow into the space under said lower opening of said enclosure and to assume a stable condition.

13. A method for housing and protecting an environmental monitoring well having a well pipe disposed in a well bore with an upper end extending toward the surface of the earth, comprising:

(a) placing a monolithic enclosure in said well bore around said upper end of said well pipe, said enclosure having an upper opening and a lower end with a lower opening, and an inwardly-protruding ledge between said upper opening and said lower opening;

(b) placing sealing means in said well bore under and in contact with said lower end of said enclosure between the outer surface of said well pipe and the inner surface of said well bore so as to seal off said lower opening of said enclosure, said sealing means comprising a material having a characteristic that allows it to flow into the space under said lower opening of said enclosure and to assume a stable condition;

(c) placing on said ledge closure means, adapted to be disposed within said enclosure at said upper end thereof and to prevent fluid from entering therethrough, said closure means having a substantially flat upper surface which is substantially flush with said surface of the earth when installed in said enclosure; and (d) attaching said closure means to said enclosure so as to seal said upper opening of said enclosure.

* * * * *